United States Patent [19]

Anderson

[11] 4,074,740

[45] Feb. 21, 1978

[54] COMBINATION POCKETBOOK AND CUSHION

[76] Inventor: Margaret Anderson, D-11 Wilshire Lane, Oakdale, L.I., N.Y. 11769

[21] Appl. No.: 776,531

[22] Filed: Mar. 11, 1977

[51] Int. Cl.[2] ..... A45C 3/06

[52] U.S. Cl. ..... 150/35; 150/33; 190/42

[58] Field of Search ..... 150/28 R, 28 A, 33, 150/35; 190/8, 42

[56] References Cited

U.S. PATENT DOCUMENTS

| | | | |
|---|---|---|---|
| 2,493,506 | 1/1950 | Schwartzbard | 150/28 A |
| 2,544,493 | 3/1951 | Filenbaum | 150/28 R |
| 2,865,433 | 12/1958 | Warner | 190/42 |
| 3,763,972 | 10/1973 | Karzmar | 190/8 |
| 3,938,569 | 2/1976 | Hill | 150/33 |

*Primary Examiner*—Donald F. Norton
*Attorney, Agent, or Firm*—Stanley Ira Laughlin

[57] ABSTRACT

A combination pocketbook and cushion wherein the cushion can be detached from the pocketbook and sat on during protracted periods of sitting such as when the carrier participates in a bingo game or the like. The pocketbook includes a flap having a snap fastener for attachment to a complemental snap fastener on the cushion. Opposite edges of both the pocketbook and cushion include rings which are connectable to snap hooks on opposite ends of a carrying handle so that the pocketbook and cushion can be carried as a unit. The pocketbook is also provided with an exterior, expandable pouch for carrying such items as tokens for playing the game of bingo.

5 Claims, 3 Drawing Figures

COMBINATION POCKETBOOK AND CUSHION

BACKGROUND OF THE INVENTION

This invention relates to a combination pocketbook and cushion construction useful by participants in such activities as bingo and the like wherein it is required to sit for long periods of time and to have a means readily available to hold a plurality of tokens for covering a bingo card.

Due to the prolonged period of time wherein a person has to sit while playing such games as bingo and the like, many women participants use their pocketbooks as a cushion. This has many disadvantages. Not only is the pocketbook marred and flattened out of shape, but a women does not have means readily available to hold a plurality of tokens which are necessary to cover a bingo card or the like. Accordingly, this invention relates to a combined pocketbook and cushion construction wherein the cushion may be detached from the bag when needed to sit on and the bag may be provided with a suitable pouch for holding a plurality of tokens. In all other respects, the bag can be used to carry normal accessories used by the woman. When not in use, the cushion may be readily carried as part of the pocketbook to avoid misplacing it in such a manner so as not to detract from the appearance of the pocketbook.

SUMMARY OF THE INVENTION

In accordance with the invention, a pocketbook is provided with an expandable pouch on one side thereof to hold a plurality of tokens. The pouch is covered by a flap having a snap which can be connected to a complemental snap on a foam cushion. The sides of the pocketbook are provided with rings, as well as the sides of the cushion. The handle for the bag is connected to the rings by snap hook fasteners, which can also be connected to the rings on the cushion so that the pocketbook and cushion, when connected by the snap fasteners to the flap on the bag, can be carried as one unit and will have the appearance of a normal pocketbook. The handle strap of the bag is expandable so that the bag can be seated in the lap of a person wherein the person will have access to the pouch on the side of the bag in a seated position.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
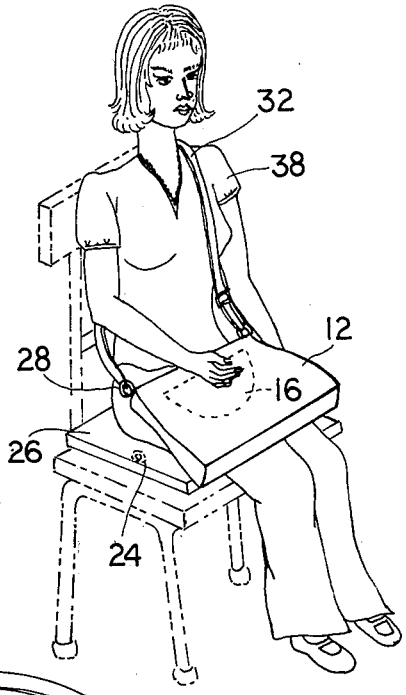
FIG. 1 is a perspective view of the pocketbook and cushion of the present invention in use.
Figure 2:
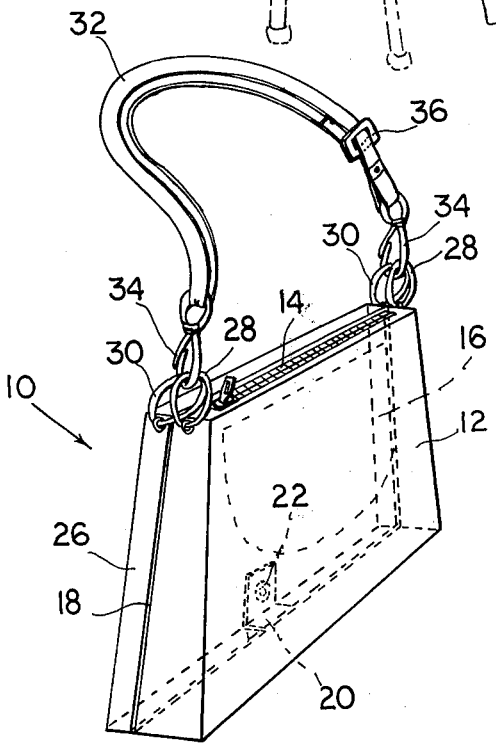
FIG. 2 is a perspective view of the pocketbook and cushion of the present invention assembled for carrying as a single unit.
Figure 3:
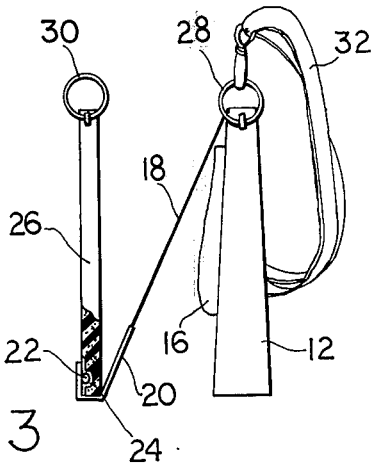
FIG. 3 is a side view in elevation, partly in section, of the pocketbook and cushion of FIG. 2, with the cushion partly detached from the pocketbook.

Referring now to the drawing in detail, wherein like numerals indicate like elements throughout the several views, the combination pocketbook and cushion construction 10 of the present invention includes a pocketbook 12 having a zipper 14 which opens the pocketbook providing access to the interior thereof.

An expandable pouch 16 is sewn to one of the front or back sides of the pocketbook 12. The other of the front or back surface of pocketbook 12 includes a pivotable flap 18 having a strap 20 connected to the bottom edge thereof. Strap 20 includes a snap fastener 22 which is received in a complemental snap fastener 24 on a foam cushion 26.

Mounted on opposite sides of pocketbook 12 are a pair of rings 28. Mounted on opposite sides of cushion 26 are a pair of rings 30. A carrying strap 32 having snap hooks 34 at opposite ends threreof are disposed in adjacent rings 28 and 30 on pocketbook 12 and cushion 26, respectively, to hold the cushion 26 to pocketbook 12 to enable the pocketbook and cushion construction to appear as one unit.

When it is desired to sit on the cushion 26, as shown in FIG. 1, for example when playing bingo, the snap hooks 34 are removed from rings 30 and cushion 26 unfastened from snap 22 on flap 18. A person can then sit on cushion 26. Strap 32 is elongatable through a buckle 36 so that with the snap hooks 34 connected to rings 28, the pocketbook 12 can be disposed in the lap of a sitting person 38. Pouch 16 will then be available to receive the various tokens used in playing a game such as bingo and the pocketbook will be attached to the person 38 so it cannot be stolen.

While a specific embodiment of a combination pocketbook and cushion has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A combination pocketbook and cushion construction comprising:

a pocketbook having a flap pivotably connected to one side thereof, a ring on opposite edges of said pocketbook a cushion a pair of rings connected to opposite edges of said cushion means on the bottom edges of said flap and said cushion for connecting said flap to said cushion, and a carrying handle for said pocketbook and cushion including fastening means connected to opposite ends of the handle for connecting said handle to said rings on both said pocketbook and said cushion.

2. The combination of claim 1 wherein said fastening means includes a snap hook on each end of said handle.

3. The combination of claim 1 wherein said handle includes an elongatable strap.

4. The combination of claim 1 wherein said connecting means between said flap and said cushion includes complemental snap fasteners.

5. The combination of claim 1 wherein said pocketbook includes an expandable pouch connected to one surface thereof.

* * * * *